United States Patent [19]

Shibata et al.

[11] Patent Number: 5,059,580

[45] **Date of Patent: * Oct. 22, 1991**

[54] THERMAL TRANSFER IMAGE RECEIVING MATERIALS

[75] Inventors: Takeshi Shibata; Seiichiro Kishida, both of Kanagawa, Japan

[73] Assignee: Fuji Photo Film Co., Ltd., Kanagawa, Japan

[ * ] Notice: The portion of the term of this patent subsequent to Feb. 12, 2008 has been disclaimed.

[21] Appl. No.: 420,425

[22] Filed: Oct. 12, 1989

[30] Foreign Application Priority Data

Oct. 14, 1988 [JP] Japan ..... 63-258563

[51] Int. Cl.[5] ..... B41M 5/35; B41M 5/26

[52] U.S. Cl. ..... 503/227; 8/471; 428/195; 428/211; 428/480; 428/513; 428/913; 428/914

[58] Field of Search ..... 8/471; 428/195, 513, 428/913, 914, 211, 335, 336, 423.1, 474.4, 511, 512, 480, 537.5; 503/227

[56] References Cited

U.S. PATENT DOCUMENTS 4,774,224 9/1988 Campbell ..... 503/227

FOREIGN PATENT DOCUMENTS 3504813 8/1986 Fed. Rep. of Germany ..... 503/227

*Primary Examiner*—Bruce H. Hess

*Attorney, Agent, or Firm*—Sughrue, Mion, Zinn, Macpeak & Seas

[57] ABSTRACT

A thermal transfer image receiving material is described, comprising a support of a paper comprising natural pulp as a principal component and having thereon a laminate layer of a thickness from 5 to 35 μm comprising a polyolefin resin as a principal component.

16 Claims, No Drawings

THERMAL TRANSFER IMAGE RECEIVING MATERIALS

FIELD OF THE INVENTION

The present invention relates to thermal transfer image receiving materials for thermal transfer recording purposes. More precisely, the present invention concerns thermal transfer image receiving materials with which the transfer density is high and with which there is little blurring or fading of the image on ageing after the image has been formed.

BACKGROUND OF THE INVENTION

Various information processing systems have been developed as a result of the rapid developments which have taken place in the information industry in recent years. Methods of recording and apparatus compatible with these information processing systems have been developed and adopted. In thermal transfer recording methods, the apparatus used is light and compact, there is little noise associated with the apparatus and they have excellent operability and maintenance characteristics. Moreover, since they also allow coloring to be achieved easily, these methods are the most widely used. Thermal transfer recording systems can be broadly classified into two types. In the first type (thermofusion type), heat is applied from the support side to a thermofusible ink which has been coated onto a support and the ink is melted in the form of a pattern corresponding to the pattern of heat applied and the ink is transferred to the recording medium (a thermal transfer image receiving material) to provide a hard copy. In the other type (thermomobile type systems), heat is applied from the support side in the same way as before to a thermal transfer dye donating material which has, on a support, a layer which contains a thermomobile dye, the dye migrates into the recording medium (thermal transfer image receiving material) in the form of the pattern in which the heat has been applied and a hard copy is obtained.

A thermomobile dye is, for example, a dye which can be transferred from a thermal transfer dye donating material to a thermal transfer image receiving material by sublimation or diffusion in a medium.

Synthetic papers in which polypropylene is the principal component are typical of the supports for thermal transfer image receiving materials used conventionally in thermal transfer recording materials. For example, thermal transfer image receiving materials in which a polyethylene resin layer is established as a dye receiving layer on a synthetic paper of which polypropylene forms the principal component have found practical application in thermomobile type thermal transfers. However, when synthetic papers of this type are used, they are thermally deformed by the heat from the thermal head. Specifically, curl, wrinkling and concavity type deformation occurs, and this reduces considerably the commercial value of the products.

The use of supports in which polyethylene is laminated on a paper in which natural pulp forms the principal component has been suggested as a means of overcoming these difficulties. However, when a general polyethylene laminated paper support has been used in the past the transfer densities have been low and it has not been possible to obtain a satisfactory maximum density. Problems have also arisen with image fading on storage at elevated temperatures after image formation.

SUMMARY OF THE INVENTION

Hence, an object of the present invention is to provide thermal transfer image receiving materials which display good letter or picture recording characteristics in various types of thermal transfer printers, where there is no thermal deformation, where adequate maximum densities are obtained, and where there is no fading of the image on ageing at elevated temperatures.

The above mentioned object is achieved with a thermal transfer image receiving material comprising a support of a paper comprising natural pulp as a principal component and having thereon a laminate layer of a thickness from 5 to 35 μm comprising a polyolefin resin as a principal component on at least the image receiving surface.

DETAILED DESCRIPTION OF THE INVENTION

The present invention is described in detail below.

The basic material of the supports used in the thermal transfer image receiving materials of the present invention is a paper in which a natural pulp forms the principal component, that is, the paper which comprises the natural pulp in an amount of at least 70 wt% based on the whole amount of the paper.

The use of wood pulp for the natural pulp is preferred. From a manufacturing point of view, the use of a chemically pulped wood pulp is more preferred. In general, a kraft pulp (sulfate pulp) or a sulfite pulp is used. Moreover, the pulp may be a bleached pulp which has been bleached to provide a high degree of whiteness.

The paper normally contains further internal additives. These internal additives are mainly added when paper is being manufactured using wood pulp. Examples of such internal additives include softening agents, paper strength reinforcing agents, sizing agents, fillers and fixing agents.

Reaction products of maleic anhydride copolymers and polyalkylenepolyamines are preferred as softening agents. Epoxidized fatty acid amides are also effective in the present invention. These materials are effective for adjusting the internal bond strength (as specified by Tappi RC-308). The softening agent may be added to the pulp at a rate of from about 0.1 to 2.0 wt% based on the amount of the pulp.

Paper strength reinforcing agents include melamine resins, urea resins, polyethyleneimine and glyoxal, for example, to improve wet strength, and polyalkylamides, starch, cationic starch, natural rubber, cellulose derivatives and seaweed extracts, for example, to improve dry strength. Of these materials, cationic starch is also effective for defining a surface size. Paper strength reinforcing agents may be included at a rate of about 0.1 to 1.0 wt% based on the amount of the pulp to improve wet strength and at a rate of about 0.2 to 2.0 wt% based on the amount of the pulp to improve dry strength.

Sizing agents include rosin, paraffin wax, higher fatty acid salts, such a sodium stearate, alkenyl succinates, fatty acid anhydrides and alkylketene dimers.

These agents improve the sizing properties.

The sizing agents are generally added to the pulp at a rate of from about 0.5 to 3.0 wt% based on the amount of the pulp.

Fillers such as clay, talc, calcium carbonate or fine particles of urea/formaldehyde resin, and fixing agents such as aluminum sulfate, polyamides, polyamine epichlorhydrins, etc. may also be added to the pulp, as required.

The fillers improve the softness, surface smoothness, printability, opaqueness, etc. of the paper.

Furthermore, the fixing agents promote the attachment of sizing agents to the surface of the fibers.

The fillers may be added to the pulp at a rate of about 1 to 15 wt% based on the amount of the pulp and the fixing agents may be added to the pulp at the rate of about 0.5 to 3.0 wt% based on the amount of the pulp.

The paper useful in the present invention can be manufactured using any known method for the manufacture of paper from wood pulp and such a process generally involves (i) pulp selection, (ii) adjustment, (iii) paper making and (iv) finishing.

More specifically, this involves the selection of, for example, (1) the type of beater and the degree of beating, (2) the wet pressing conditions and (3) the drying conditions.

The paper can be made using a long net type paper making machine or a circular net type paper making machine A paper weight of from 20 to 200 g/m$^2$ is preferred, and a paper weight of from 30 to 100 g/m$^2$ is especially preferred. A paper thickness of from 25 to 250 μm, and most desirably of from 40 to 150 μm, is preferred.

Furthermore, the paper is preferably subjected to a calendering treatment, such as an on-machine calendering treatment on the paper making machine or an super-calendering treatment after the paper has been made, to improve surface smoothness.

The paper density is preferably set by means of the above mentioned calendering treatment to 0.7 to 1.2 g/m$^3$, and most desirably to 0.85 to 1.10 g/m$^3$, as specified in JIS-P-8118.

Paper of the type described above can be used as it is as a base material, but the use of paper supports on which a layer of a hydrophobic polymer has been established on one side or on both sides of the paper is preferred. The layer of hydrophobic polymer may be coated on one side or both sides of the paper with a structure comprising a plurality of laminated layers.

Moreover, known surface sizing agents can be coated onto the surface of the paper and the layer of hydrophobic polymer may be coated onto the surface of the paper onto which the surface sizing agents have been coated. Examples of surface sizing agents include poly(vinyl alcohol), starch, polyacrylamide, gelatin, casein, styrene/maleic anhydride copolymer, alkylketene dimer, polyurethane and epoxidized fatty acid amides.

The hydrophobic polymer used for the coating layer preferably has a glass transition temperature of from −20° C. to 50° C. The polymer may be a homopolymer or a copolymer. Furthermore, in the case of a copolymer the copolymer may have hydrophilic repeating units in portions thereof as long as the entire copolymer is hydrophobic. Examples of the above mentioned hydrophobic polymers include poly(vinylidene chloride), styrene/butadiene copolymers, methyl methacrylate/-butadiene copolymers, styrene/acrylate ester copolymers, methyl methacrylate/acrylate ester copolymers, and styrene/methacrylate/acrylate ester copolymers.

The formation of a crosslinked structure in the above mentioned hydrophobic polymers is desirable. Known curing agents (crosslinking agents) can be used along with the hydrophobic polymer when preparing the paper in order to form a crosslinked structure in the hydrophobic polymer. Examples of such curing agents include active vinyl compounds such a 1,3-bis(vinylsulfonyl)-2-propanol and methylenebismaleimide; active halogen compounds such as the sodium salt of 2,4-dichloro-6-hydroxy-s-triazine, 2,4-dichloro-6-hydroxy-s-triazine and N,N'-bis(2-chloroethylcarbamyl)piperazine; epoxy compounds, such as bis(2,3-epoxypropyl)-methylpropyl-ammonium.p-toluenesulfonate; and methanesulfonic acid esters, such as 1,2-di(methanesulfonoxy)ethane.

Pigments may be included in the coated hydrophobic polymer layers to improve the smoothness of the coated surface and to simplify the layer forming process during manufacture. The pigments used in known coated papers (coated papers, art papers, baryta paper, etc.) can be used for the above mentioned pigments. Examples of such pigments include inorganic pigments such as titanium dioxide, barium sulfate, talc, clay, kaolin, baked kaolin, aluminum hydroxide, amorphous silica, crystalline silica and synthetic aluminasilica, and organic pigments such as polystyrene resins, acrylic resins and urea/formaldehyde resins.

Waterproofing agents can also be added to the coated hydrophobic polymer layers. Examples of such waterproofing agents include polyamide polyamine-epichlorhydrin resins, polyamide polyurea resins and glyoxal resins. Of these, the formadehyde free polyamide polyamine epichlorhydrin resins and the polyamide polyurea resins are especially desirable.

Hydrophobic polymer coating layers of the type described above can be produced easily by coating a latex type coating liquid in which the hydrophobic polymer, curing agent, pigments, waterproofing agents, etc. have been dissolved, dispersed or emulsified onto the base paper. Known methods including dip coating, air knife coating, curtain coating, roll coating, doctor coating and gravure coating, for example, can be used to coat the coating liquid onto the base paper.

The coated layer of hydrophobic polymer is preferably formed on the base paper at a coated amount (total weight where a plurality of such layers is formed) of at least 3 g/m$^2$. A coated amount of from 5 to 30 g/m$^2$ is especially preferred.

Moreover, calendering treatments such as cross calendering or super-calendering can be carried out during or after the coating of the above mentioned coated layer to improve the smoothness of the paper.

Furthermore, treatments with a casting procedure are also desirable.

Moreover, the mixed paper, mixed paper which has been subjected to a calendering treatment, or mixed paper which has a coated layer which contains pigment and hydrophobic polymer formed one or both sides can be used.

A hydrophilic binder and semiconductor metal oxide such as alumina sol or tin oxide, carbon black or some other anti-static agent may be coated onto the surface of these supports.

Furthermore, the anti-static layers disclosed in JP-A-61-197283 can also be coated onto the surface of these supports. (The term "JP-A" as used herein means an "unexamined published Japanese Patent Application".)

In the present invention, a laminated layer of a thickness from 5 to 35 μm where the principal component is a polyolefin resin, that is, which comprises the polyolefin resin in an amount of at least 80 wt% based on the whole weight of the laminated layer, is present on at least the image receiving side of the above mentioned paper base material. A high transfer density is obtained with a laminated layer thickness within this range, no image unevenness arises due to the roughness of the base paper, and there is a further advantage in that there is no fading of the image on storage at elevated temperatures.

On the other hand, unevenness arises in the image during transfer due to the roughness of the base paper where the thickness of the laminated layer is less than 5 μm, and the transfer density falls and image fading occurs on storage at elevated temperatures where the laminated layer thickness exceeds 35 μm.

In the present invention, the thickness of the laminated layer is preferably from 5 μm to 25 μm.

Attachment to the paper is poorer when the laminated polyolefin film is thin and this can result in failure during image transfer. As a result of investigations of the various conditions of the lamination process, it has now been found that laminates which have good attachment to the paper can be obtained by using a higher melt lamination temperature (250° C to 350° C.) than usual.

Polyolefins of various densities and melt indexes, such as low density polyethylene (density from about 0.91 to about 0.925), high density polyethylene (density from about 0.925 to about 0.965), and polypropylene can be used, either alone or in the form of mixtures, for the polyolefin which is used in the present invention.

The use of low density polyethylene on the image receiving side increases the transfer density and this is especially preferred in the present invention.

The lamination of polyolefin resin on both sides of the base paper is preferred in the present invention for improving the curl balance of the support.

Furthermore, white pigments such as titanium oxide, metal salts of resin acids, zinc oxide, talc and calcium carbonate, antioxidants such as aliphatic amines, including stearic acid amide and arachidic acid amide, tetrakis [methylene-3-(3,5-di-tert-butyl-4-hydroxphenyl)-propionate] methane and 2,6-di-tert-butyl-4-methylphenol, pigments such as ultramarine and Bengal, and fluorescent whiteners can be added to the polyolefin resin compositions, and especially to the resin compositions used for the polyolefin laminates which are formed on the image receiving surface, in the present invention.

The titanium oxide used in the present invention may be a commercial titanium oxide which has been modified by the precipitation of hydrated aluminum oxide and/or hydrated silicon dioxide on the surface of the particles. Furthermore, titanium oxide which has a weight loss on drying of not more than 0.35 wt% and which has a weight loss on drying after an organic treatment such as a silanol surface treatment or treatment with the metal salt of a fatty acid such as zinc stearate or calcium stearate, for example, of not more than 0.35 wt% is another useful form of titanium oxide. Titanium oxides which have either a rutile form or an anatase form can be used provided that the loss of weight on drying for 2 hours at 110° C. is not more than 0.35 wt% based on the weight of titanium oxide prior to drying.

The titanium oxide content of the polyolefin resin is from 5 to 40 wt%, and preferably from 9 to 25 wt%, based on the polyolefin resin composition.

An electrically conductive metal oxide such as an alumina sol or $SnO_2$ may be coated onto the support surface in the present invention in order to provide antistatic and/or slip properties. The provision of a gelatin layer which contains such electrically conductive metal oxides on the opposite surface to the image receiving surface is especially preferred.

The surface finish of the support may be a glossy or matt finish. The image receiving side may be glossy and the back may be a matt finish or these may be reversed. The use of a matt finish on the back surface is especially good for preventing sticking.

An dye image receiving layer is established, as required, on the thermal transfer image receiving material. This receiving layer has the action of taking up the dye which migrates from the thermal transfer dye donating material during printing and fixing the dye. In practice, the use of a receiving film of a thickness of from 3 μm to 50 μm which contains a synthetic resin of the type described below is preferred. The synthetic resin preferably has an average molecular weight of 5,000 to 100,000.

(i) Resins which have Ester Bonds

Examples include polyester resins, poly(acrylic acid ester) resins, polycarbonate resins, poly(vinyl acetate) resins, styrene acrylate resins and vinyltoluene acrylate resins.

Preferred polyester resins contain anionic groups and have phenyl groups in the main chain. In this context, an anionic group is a group which displays anionic properties in a polyester resin, and those which take the form of a metal salt are preferred.

(1) Polyesters which contain anionic groups can be broadly classified as those containing anionic groups in the dicarboxylic acid moieties from which the polyester is formed, and those containing anionic groups in the diol moieties from which the polyester is formed.

Groups such as $-COO^{\ominus}$ and $-SO_3^{\ominus}$ are preferred as anionic groups.

Specific examples are indicated below. Here, the anionic group is represented by a sulfonic acid group, but the same effect can be achieved using other anionic groups.

(a) Polyesters Which Have Anionic Groups in the Dicarboxylic Acid of the Polyester Those in which anionic groups are present in an isophthalic acid moiety:

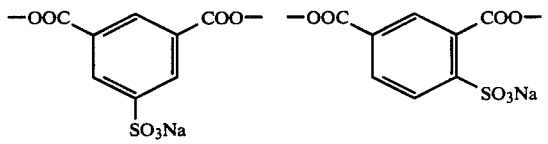

Those in which anionic groups are present in a terephthalic acid moiety:

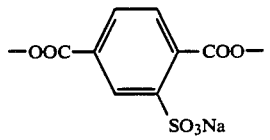

Those in which anionic groups are present in a long chain carboxylic acid ($-OOC-(CH_2)_n-COO-$ 13, where $n \geqq 3$):

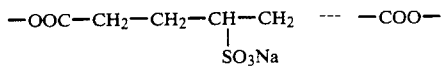

Those in which anionic groups are present in the diol moiety of the polyester are described below.

Those in which anionic groups are present in bisphenol A:

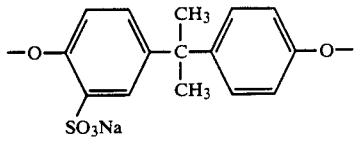

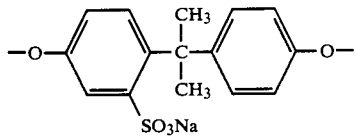

Those in which anionic groups are present in a long chain diol ($-O-(CH_2)_n-O-$, where $n \geqq 3$):

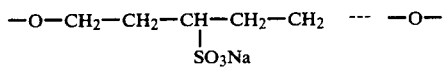

(2) Polyesters containing phenyl groups in the linear chain can be broadly classified as those containing phenyl groups in the dicarboxylic acid moieties from which the polyester is formed and those containing phenyl groups in the diol moieties from which the polyester is formed.

(a) Examples in which phenyl groups are present in the linear chain in the dicarboxylic acid of the polyester are shown below.

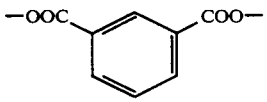

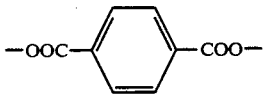

(b) Examples in which phenyl groups are present in the diol moiety are shown below.

Bisphenol A
Bisphenol B
Bisphenol AF
Bisphenol S

The use of polyesters containing phenyl groups in the diol components is preferred.

The use of polyesters containing phenyl groups in the diol components and anionic groups in the dicarboxylic acid components is especially preferred.

Furthermore, "Vylon 280", "Vylon 290" and "Vylon 300" made by Toyo Boseki, and "Kao B" and "Kao C" made by Kao can be used and are commercially available products.

(ii) Resins which have Urethane Bonds

For example, polyurethane resins.

(iii) Resins which have Amide Bonds

For example, polyamide resins.

(iv) Resins which have Urea Bonds

For example, urea resins.

(v) Resins which have Other Highly Polar Bonds

For example, polycaprolactone resins, styrene/-maleic anhydride resins, poly(vinyl chloride) resins and polyacrylonitrile resins.

The synthetic resins described above can be used alone, or they can also be used in the form of mixtures or copolymers thereof.

Furthermore, the receiving layer can be formed from two or more types of resin which have different properties.

Moreover, the receiving layer may take the form of a film comprising a dispersion of a water soluble polymer and the above described resins. The use of a dispersion of the polyester resin and gelatin is especially effective.

Also, the receiving layers can be formed containing fine silica power in addition to the resins described above.

In this context, silica signifies silicon dioxide or a substance containing silicon dioxide as the principal component. A silica of an average particle size from 10 to 100 mμ and of a specific surface area less than 250 $m^2/g$, and preferably of an average particle size from 10 to 50 mμ and of a specific surface area from 20 to 200 $m^2/g$, can be used for the fine silica powder which is present in the receiving layer.

Furthermore, the amount of fine silica powder present is within the range from 5 to 20 wt%, and preferably within the range from 5 to 10 wt%, based on the weight of the receiving layer.

These fine silica powders may be added beforehand to the resins which are used to form the receiving layers and the receiving layers can be formed by coating and drying the a resin mixture solution obtained in this manner on the support.

Release agents can be present in the receiving layers of the thermal transfer image receiving materials of the present invention to improve the release properties from the thermal transfer dye donating material. Solid waxes, such as polyethylene wax, amide wax or Teflon powder, surfactants such as fluorinated and phosphate ester based surfactants; and silicone oils can be used as release agents, but the use of silicone oils is preferred.

Various silicone oils (i.e. silicone oils ranging from dimethylsilicone oil to modified silicone oils in which various organic groups have been introduced into dimethylsiloxane) can be used for the above mentioned silicone oil. For example, the use of the various modified silicone oils described in Technical Data Sheet P6-18B entitled "Modified Silicone Oils", published by the Shinetsu Silicone Co. is effective for this purpose.

High boiling point organic solvents and thermal solvents can be used in the present invention to obtain higher transfer densities.

Esters (for example, phthalate esters, phosphate esters and fatty acid esters), amides (for example, fatty acid amides and sulfoamides), ethers, alcohols, paraffins and silicone oils which are liquids at normal temperatures and which do not volatalize at the heating temperature are preferred as high boiling point organic solvents. The high boiling point organic solvents preferably have a boiling point of at least 180° C., particularly at least 200° C., at an atmospheric pressure.

Compounds which have various properties, which is to say (1) which are compatible with the dyes, (2) which are solids at normal temperature but which melt (which may involved mixed melting with another component) when heated by the thermal head during transfer, and (3) which are not decomposed by heat from the thermal head can be used as the thermal solvents. Preferred compounds have a melting point of from 35° C. to 250° C., and most desirably of from 35° C. to 200° C., and are materials where the value of the ratio (inorganic nature-/organic nature) has a value of less than 1.5. Here, the designation of an inorganic nature and an organic nature is a concept used for estimating the nature of compounds, and this has been described in detail, for example, in *The Realm of Chemistry,* 11. page 719 (1957) In practice, use can be made of the compounds disclosed in JP-A-136646.

The high boiling point organic solvents and/or thermal solvents may be present alone in the form of a micro-dispersion in the receiving layer or they may be present as mixtures with other components such as a binder, for example.

The above described high boiling point organic solvents may also be used to improve slip properties, anti-stick properties and peeling properties, and to improve curl balance. A high boiling point organic solvent may also be present in the form of oil droplets where the receiving layer contains a hydrophilic binder.

Anti-color fading agents can also be present in the thermal transfer image receiving materials of the present invention. Antioxidants, ultraviolet absorbers and various metal complexes can be used as anti-color fading agents.

Examples of antioxidants include chroman based compounds, coumarane based compounds, phenol based compounds (for example, hindered phenols), hydroquinone derivatives, hindered amine derivatives and spiroindane derivatives.

Benzotriazole based compounds (for example, those disclosed in U.S. Pat. No. 3,533,794), 4-thiazolidone based compounds (for example, those disclosed in U.S. Pat. No. 3,352,681), benzophenone based compounds (for example, those disclosed in JP-A-46-2784), and other compounds disclosed, for example, in JP-A-54-48535, JP-A-62-136641 and JP-A-61-88256 can be used as ultraviolet absorbers.

The compounds disclosed, for example, in U.S. Pat. No. 4,241,155, columns 3–36 of U.S. Pat. No. 4,245,018, columns 3–8 of U.S. Pat. No. 4,254,195, JP-A-62-174741, pages 27–29 of JP-A-61-88256, Japanese Patent Application Nos. 62-234103 and 62-31096 (corresponding to JP-A-1-75568 and JP-A-63-199248, respectively), and Japanese Patent Application No. 62-230596 can be used as metal complexes.

The above mentioned antioxidants, ultraviolet absorbers and metal complexes may be used alone or in combination, if desired.

Moreover, fluorescent whiteners can be present in the thermal transfer image receiving materials of the present invention. The incorporation of fluorescent whiteners in the image receiving materials or the supply of these materials externally, for example, from the dye donating material, is preferred. The compounds described, for example, in K. Veenkataraman, *The Chemistry of Synthetic Dyes,* Volume V, Chapter 8, and those disclosed in JP-A-61-143752 are examples of suitable fluorescent whiteners. More specifically, fluorescent whiteners include stilbene based compounds, coumarin based compounds, biphenyl based compounds, benzoxazolyl based compounds, naphthalimide based compounds, pyrazoline based compounds and carbostyril based compounds.

The fluorescent whiteners can be used in combination with anti-color fading agents, if desired.

Matting agents can be present in the thermal transfer image receiving materials of the present invention. In addition to the compounds such as silicon dioxide, polyolefins, polymethacrylates, etc., disclosed on page 29 of JP-A-63-88256, benzoguanamine resin beads, polycarbonate resin beads, AS resin beads, etc. disclosed, for example, in Japanese Patent Application Nos. 62-110064 and 62-110065 (corresponding to JP-A-63-274944 and JP-A-63-274953, respectively), and Japanese Patent Application No. 62-051410 can be used as matting agents.

Various film hardening agents can be present in the thermal transfer image receiving materials of the present invention.

The film hardening agents disclosed, for example, in column 41 of U.S. Pat. No. 4,678,739, JP-A-59-116655, JP-A-62-245261 and JP-A-611-18942 can be used as film hardening agents when gelatin included as a binder. More specifically aldehyde based film hardening agents (for example, formaldehyde), aziridine based film hardening agents, epoxy based film hardening agents:

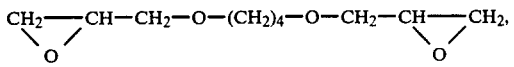

for example), vinyl sulfone based film hardening agents (for example, N,N'-ethylenebis(vinylsulfonylacetamido)ethane), N-methylol based film hardening agents (for example, dimethylol urea) or polymeric film hardening agents (the compounds disclosed, for example, in JP-A-62-234157) can be used.

Furthermore isocyanate compounds are effective as film hardening agents for receiving layers which contain polyester resins.

Intermediate layers may be formed between the support and the receiving layers in the thermal transfer image receiving materials of the present invention.

The intermediate layers may be either cushioning layers or porous layers or diffusion resistant layers, depending on the material from which the layer is formed, or they may fulfill the role of an adhesive depending on the particular case.

Polymers which satisfy the above described conditions are indicated below.

Polyurethane resins
Polyester resins
Polybutadiene resins
Poly(acrylic acid ester) resins
Epoxy resins
Polyamide resins
Rosin modified phenolic resins
Terpene/phenol resins
Ethylene/vinyl acetate copolymer resins Examples of hydrophilic binders include natural products including proteins such a gelatin or gelatin derivatives, cellulose derivatives, and polysaccharaides such as starch, gum arabic, dextran and pullulan, and poly(vinyl alcohol), polyvinylpyrrolidone, acrylamide polymers and other synthetic polymer materials.

The above described resins can be used individually or in the form of mixtures of two or more types of resin, if desired.

Layers used as porous layers include (1) layers where a liquid comprising an emulsion of a synthetic resin, such as a polyurethane, for example, or a synthetic rubber latex, such as a methyl methacrylate/butadiene based synthetic rubber latex, which has been agitated mechanically to incorporate bubbles thereinto is coated onto a support and dried, (2) layers where a liquid obtained by mixing a forming agent with the above mentioned synthetic resin emulsions or synthetic rubber latexes is coated onto the support and dried, (3) layers where a liquid obtained by mixing a foaming agent with a vinyl chloride plastisol, a synthetic resin such as a polyurethane or a synthetic rubber such as a styrene/-butadiene based synthetic rubber is coated onto a support and foamed by heating, and (4) layers where a liquid mixture comprising a solution obtained by dissolving a thermoplastic resin or a synthetic rubber in an organic solvent and an non-solvent (including those consisting principally of water) which is less volatile than the organic solvent and compatible with the organic solvent and where the thermoplastic resin or synthetic rubber is not soluble, is coated onto a support and dried to form a film where the non-solvent has aggregated in a micro form to provide a microporous layer.

Layers which contain gelatin as the principal component are preferred for the intermediate layers.

The above described intermediate layers may be formed on both sides of the thermal transfer image receiving material where receiving layers are present on both sides, or on just one side of the base sheet. Furthermore, the thickness of an intermediate layer is from 0.5 to 50 μm, and most desirably from 2 to 20 μm.

An anti-static agent can be present in the receiving layer on at least one side, or at the surface of the receiving layer, of the thermal transfer image receiving material of the present invention. Examples of anti-static agents include surfactants, for example, cationic surfactants (for example, quaternary ammonium salts, polyamine derivatives), anionic surfactants (for example, alkylphosphates), amphoteric type surfactants, nonionic surfactants, and fluorine based surfactants.

The thermal transfer image receiving materials of the present invention are used in combination with thermal transfer dye donating materials.

In one embodiment of a thermal transfer dye donating material the thermal transfer layer on a support is a thermomobile type thermal transfer layer comprising a thermomobile dye and a binder resin. Thermal transfer dye donating materials of this embodiment are obtained by preparing a coating solution in which a well known thermomobile dye, i.e., a sublimation transfer type dye, and a binder resin are dissolved or dispersed in an appropriate solvent and coating the solution onto one side of a support well known for use in thermal transfer dye donating materials at a rate so as to provide a dry film thickness of, for example, about 0.2 to 5.0 μm, and preferably of from 0.4 to 2.0 μm, and drying to form a thermomobile type thermal transfer layer.

Dyes used conventionally in thermal transfer dye donating materials can be used as the dyes which are effective for forming such a thermal transfer layer, but in the present invention the use of dyes which have a low molecular weight of about 150 to 800 is preferred. The dyes are selected based on transfer temperature, hue, light fastness and solubility or dispersibility in an ink or binder, etc.

More specifically, these dyes include disperse dyes, basic dyes and oil soluble dyes, and examples of actual dyes which can be preferably used include "Sumicron Yellow E4GL", "Dyanics Yellow H2G-FS", "Miketone Polyether Yellow 3GSL", "Kayaset Yellow 937", "Sumicron Red EFBL", "Dyanics Red ACE", "Miketone Polyether Red FB", "Kayaset Red 126", "Miketone Fast Brilliant Blue B", and "Kayaset Blue 136".

Furthermore, use can be made of the yellow dyes disclosed, for example, in JP-A-59-78895, JP-A-60-28451, JP-A-60-28453, JP-A-60-53564, JP-A-611-148096, JP-A-60-239290, JP-A-60-31565, JP-A-60-30393, JP-A-60-53565, JP-A-60-27594, JP-A-61-262191, JP-A-60-152563, JP-A-611-244595, JP-A-62-196186, JP-A-63-142062, JP-A-63-39380, JP-A-62-290583, JP-A-63-111094, JP-A-63-111095, JP-A-63-122594, JP-A-63-71392, JP-A-63-74685, JP-A-63-74688 and Japanese Patent Application No. 63-51285 (corresponding to U.S. patent application Ser. No. 318,871 filed on Mar. 6, 1989) Japanese Patent Application No. 63-51285 describes these dyes represented by the following general formula (I):

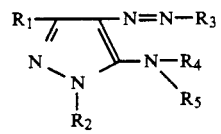

(I)

wherein, $R_1$ represents a hydrogen atom, an alkyl group, an alkoxy group, an aryl group, an alkoxycarbonyl group, a cyano group or a carbamoyl group; $R_2$ represents a hydrogen atom, an alkyl group or an aryl group; $R_3$ represents an aryl group or a heterocyclic group; $R_4$ and $R_5$, may be the same or different, each represents a hydrogen atom or an alkyl group; and the above mentioned groups may be further substituted.

Use can also be made of the magenta dyes disclosed, for example, in JP-A-60-223862, JP-A-60-28452, JP-A-60-31563, JP-A-59-78896, JP-A-60-31564, JP-A-60-303391, JP-A-61-227092, JP-A-61-227091, JP-A-60-30392, JP-A-60-30694, JP-A-60-131293, JP-A-61-227093, JP-A-60-159091, JP-A-61-262190, JP-A-62-33688, JP-A-63-5992, JP-A-61-12392, JP-A-62-551194, JP-A-62-297593, JP-A-63-74685, JP-A-63-74688, JP-A-62-97886, JP-A-62-132685, JP-A-61-163895, JP-A-62-211190, JP-A-62-99195 and Japanese Patent Application No. 62-220793 (corresponding to JP-A-1-63194 or U.S. patent application Ser. No. 239,580 filed on Sept. 1, 1988). Japanese Patent Application No. 62-220793 describes these dyes represented by the following general formula (II):

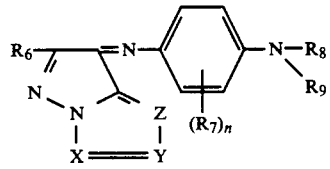

(II)

wherein $R_6$ and $R_7$, which may be the same or different, each represents a hydrogen atom, a halogen atom, an alkyl group, a cycloalkyl group, an alkoxy group, an aryl group, an aryloxy group, an aralkyl group, a cyano group, an acylamino group, a sulfonylamino group, a ureido group, an alkylthio group, an arylthio group, an alkoxycabonyl group, a carbamoyl group, a sulfamoyl group, a sulfonyl group, an acyl group or an amino group; and $R_8$ and $R_9$, which may be the same or different, each represents an alkyl group, a cycloalkyl group, an aralkyl group or an aryl group, $R_8$ and $R_9$ may also join together to form a ring, and a ring may also be formed by $R_7$ and $R_8$, and by $R_7$ and $R_9$; n represents an integer of from 0 to 3; X, Y and Z represent a $$-\overset{\overset{R_{10}}{|}}{C}=$$

group or a nitrogen atom, where $R_{10}$ represents a hydrogen atom, an alkyl group, a cycloalkyl group, an aralkyl group, an aryl group, an alkoxy group, an aryloxy group or an amino group; furthermore, when X and Y, or Y and Z are a $$-\overset{\overset{R_{10}}{|}}{C}=$$

group they may join together to form a saturated or unsaturated carbocyclic ring; and the groups indicated above may be further substituted.

Use can also be made of the cyan dyes disclosed, for example, in JP-A-59-78894, JP-A-59-227490, JP-A-60-151098, JP-A-59-227493, JP-A-61-244594, JP-A-59-227948, JP-A-60-131292, JP-A-60-172591,JP-A-60-151097,JP-A-60-131294,JP-A-60-217266, JP-A-60-31559, JP-A-60-53563, JP-A-61-255897, JP-A-60-239289, JP-A-61-22993, JP-A-61-19396, JP-A-61-368493, JP-A-61-35994, JP-A-61-31467, JP-A-61-148269, JP-A-61-49893, JP-A-61-57651, JP-A-60-239291,JP-A-60-239292,JP-A-61-284489,JP-A-62-191191, JP-A-62-138291, JP-A-62-288656, JP-A-63-57293, JP-A-63-15853, JP-A-63-144089, JP-A-63-15790, JP-A-62-311190, JP-A-63-74685, JP-A-63-74688, JP-A-62-132684, JP-A-62-87393, JP-A-62-255187 and Japanese Patent Application No. 62-176625 (corresponding to JP-A-1-20194 or U.S. patent application Ser. No. 218,789 filed on July 14, 1988). Japanese Patent Application No. 62-176625 describes these dyes represented by the following general formula (III):

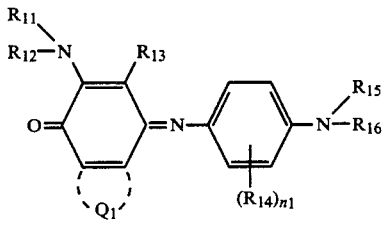

(III)

wherein $Q_1$ represents a group of atoms, including at least one nitrogen atom, required to form, together with the carbon atoms to which they are bound, a nitrogen containing heterocyclic ring which contains at least five atoms; $R_{11}$ represents an acyl group or a sulfonyl group; $R_{12}$ represents a hydrogen atom or an aliphatic group having from 1 to 6 carbon atoms; $R_{13}$ represents a hydrogen atom, a halogen atom, an alkoxy group or an aliphatic group having from 1 to 6 carbon atoms; $R_{14}$ represents a halogen atom, an alkoxy group or an aliphatic group having from 1 to 6 carbon atoms; $n_1$ represents an integer of 0 to 4; $R_{13}$ may be joined to $R_{11}$, $R_{12}$ or $R_{14}$ to form a ring; $R_{15}$ and $R_{16}$, which may be the same or different, each represents a hydrogen atom, an aliphatic group having from 1 to 6 carbon atoms, or an aromatic group; $R_{15}$ and $R_{16}$ may also join together to form a ring; and $R_{15}$ and/or $R_{16}$ may join with $R_{14}$ to form a ring.

All of the well known binder resins conventionally used for this purpose can be used as binder resins together with the dyes described above. The binder resin is usually selected to provide a high resistance to heat and to have properties such that the migration of the dye is not impeded when it is heated. For example, polyamide based resins, polyester based resins, epoxy based resins, polyurethane based resins, polyacrylic resins (for example, poly(methyl methacrylate), polyacrylamide, polystyrene-2-acrylonitrile), vinyl based resins such as polyvinylpyrrolidone, poly(vinyl chloride) based resins (for example, vinyl chloride/vinyl acetate copolymers), polycarbonate based resins, polystyrene, poly(phenylene oxide), cellulose based resins (for example, methylcellulose, ethylcellulose, carboxymethylcellulose, cellulose acetate hydrogen phthalate, cellulose acetate, cellulose acetate propionate, cellulose acetate butyrate, cellulose triacetate), poly(vinyl alcohol) based resins (for example, poly(vinyl alcohol) and partially saponified poly(vinyl alcohol)s such as poly(vinyl butyral), petroleum based resins, rosin derivatives, coumarone/indene resins, terpene based resins and polyolefin based resins (for example, polyethylene, polypropylene) can be used.

Binder resins of this type are preferably used at a rate, for example, of from about 80 to 600 parts by weight per 100 parts by weight of dye.

Ink solvents conventionally known can be used freely as ink solvents for the dissolution or dispersion of the above described dyes and binder resins in the present invention. Specific examples include alcohols such as methanol, ethanol, isopropyl alcohol, butanol and isobutanol, ketones such as methyl ethyl ketone, methyl isobutyl ketone and cyclohexanone, aromatic solvents such as toluene and xylene, halogenated solvents such as dichloromethane and trichloroethane, dioxane, and tetrahydrofuran, and mixtures of these solvents can also be used. These solvents are selected and used to achieve at least the prescribed concentration of the dye which is being used and to provide a satisfactory dissolution of dispersion of the binder resin. For example, an amount of solvent of about 9 to 20 times the total amount of dye and binder resin is desirable.

The thermal transfer dye donating materials obtained in the manner described above are laminated with the thermal transfer image receiving materials of the present invention and heated in accordance with an image signal using a heating device such as a thermal head, for example, from either side. Preferably heating is from the reverse side of the thermal transfer dye donating material. As a result of this, the dye in the thermal transfer layer is moved and transferred in accordance with the magnitude of the thermal energy applied, simply and with comparatively low energy, to the receiving layer of the thermal transfer image receiving material. Thus, it is possible to obtain color images which have excellent sharpness and tone resolution.

In a second embodiment of a thermal transfer dye donating material, the thermal transfer layer of the thermal transfer dye donating material is a thermofusible transfer layer comprising a dye or pigment and a wax. This type thermal transfer dye donating material is obtained by preparing an ink for the formation of a thermal transfer layer comprising a wax which contains a coloring agent, such as a dye or a pigment, and forming a thermofusible transfer layer from the ink on one surface of a conventional support for a thermal transfer dye donating material. The ink is obtained by compounding and dispersing a colorant such as carbon black or various dyes and pigments, for example, in a wax which has an appropriate melting point, such as paraffin wax, microcrystalline wax, carnauba wax or a urethane base wax, for example, as a binder. The proportions of dye or pigment and wax used are such that the dye or pigment accounts for about 10 to 65 wt% of the thermofusible transfer layer which is formed. The thickness of the layer which is formed is preferably from about 1.5 μm to about 6.0 μm. The preparation of the ink and its application to the support can be achieved using techniques which are already well known.

Any of the known supports can be used as the support for the thermal transfer dye donating materials used in the first and second embodiments of the thermal transfer dye donating materials described above. For example, use can be made of polyesters, for example, poly(ethylene terephthalate); polyamides; polycarbonates; glassine paper; condenser paper; cellulose esters; fluoropolymers; polyethers; polyacetal; polyolefins; and polyimides, poly(phenylene sulfide), polypropylene, polysulfone, allophane and polyimides.

The support used for a thermal transfer dye donating material generally has a thickness of from 2 μm to 30 μm. The support may be covered with a subbing layer, if desired.

A dye barrier layer comprising a hydrophilic polymer may be used between the support and the dye layer in the dye donating material, and the transfer density of the dye can be improved in this way.

The dye containing layer of the thermal transfer dye donating material can be covered by a slipping layer which prevents the print head from sticking to the dye donating material. Such a slipping layer may be a lubricating substance, such as a surfactant, a liquid lubricant, a solid lubricant or a mixture of these materials, and it may or may not contain a polymer binder.

The following examples are given to further illustrate the present invention. Unless otherwise indicated, all parts, percents, ratios and the like are by weight.

EXAMPLE 1

Preparation of a Thermomobile Type Thermal Transfer Dye Donating Material

A polyester film (Lumilar, made by Toray) of a thickness of 4.5 μm, on which a heat resistant slip layer comprising a thermoset acrylic resin had been formed on one side, was used as a support and cyan, magenta and yellow regions were coated in sequence repeatedly on the surface of the support opposite to that on which the heat resistant slip layer had been formed, using inks for thermal transfer layer formation having the compositions shown below to provide coated amounts, after drying, of 1 g/m$^2$, and a thermal transfer dye donating material was obtained.

| Composition of Cyan Ink for Thermal Transfer Layer | |
|---|---|
| Disperse Dye (Kayaset Blue 714, made by Nippon Kayaku) | 5 parts |
| Poly(vinyl butyrate) Resin (Esleck BX-1, made by Sekisui Kagaku) | 4 parts |
| Methyl Ethyl Ketone | 46 parts |

-continued

| Composition of Cyan Ink for Thermal Transfer Layer | |
|---|---|
| Toluene | 45 parts |

| Composition of Magenta Ink for Thermal Transfer Layer | |
|---|---|
| Disperse Dye (MS Red G: made by Mitsui Toatsu Kagaku) (Disperse Red 60) | 2.6 parts |
| Disperse Dye (Macrolex Violet R: made by Bayer) (Disperse Violet 26) | 1.4 parts |
| Poly(vinyl butyral) Resin (Esleck BX-1: made by Sekisui Kagaku) | 4.3 parts |
| Methyl Ethyl Ketone | 45 parts |
| Toluene | 45 parts |

| Composition of Yellow Ink for Thermal Transfer Layer | |
|---|---|
| Disperse Dye (Macrolex Yellow 6G: made by Bayer) (Disperse Yellow 201) | 5.5 parts |
| Poly(vinyl butyral) Resin (Esleck BX-1: made by Sekisui Kagaku) | 4.5 parts |
| Methyl Ethyl Ketone | 45 parts |
| Toluene | 45 parts |

Preparation of the Thermal Transfer Image Receiving Material

Structure of Support

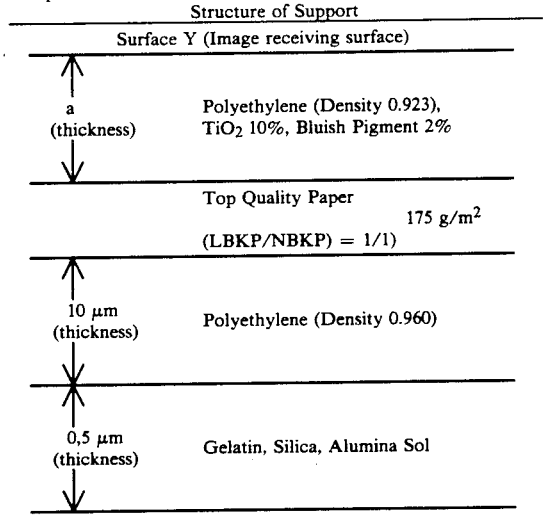

LBKP = Hardwood Bleached Kraft Pulp;
NBKP = Softwood Bleached Kraft Pulp

Support (A), in which a indicated above was 30 μm, was used to form a thermal transfer image receiving material (1) on the A surface of which a composition for dye receiving layer purposes as described below was coated using a wire bar coater to provide a dry film thickness of 10 μm. Drying was achieved in an oven for 30 minutes at 100° C. after preliminary drying in a drier.

| Composition of a Receiving Layer | |
|---|---|
| Polyester Resin (Kao C: made by Kao) | 20 grams |
| Amino Modified Silicone Oil (KF-857: made by Shinetsu Silicones) | 0.5 grams |
| Isocyanate (KP-90: made by Dainippon Ink Kagaku) | 2 grams |
| Methyl Ethyl Ketone | 85 ml |

-continued

| Composition of a Receiving Layer | |
|---|---|
| Toluene | 85 ml |
| Cyclohexanone | 30 ml |

Supports (B)-(G) were produced in the same manner as Support (A) except for the differences indicated below.

| Support | Modification of Support (A) |
|---|---|
| | Thickness |
| (B) | a = 40 μm |
| (C) | a = 10 μm |
| (D) | a = 2 μm |
| (E) | Top quality paper → Cast coat paper, 110 g/m$^2$ |
| (F) | Top quality paper, 100 g/m$^2$ |
| (G) | Polyethylene → Polypropylene |

The thermal transfer image receiving materials and the thermal transfer dye donating material obtained in the manner set forth above were laminated together in so that the thermal transfer layer was in contact with the receiving layer in each case. Printing was carried out using a thermal head from the support side of the thermal transfer dye donating material under conditions of a thermal head output of 0.30 W/dot, a pulse width of 0.15 to 15 msec, a dot density of 6 dot/mm, and the magenta dye dyed the receiving layer of the thermal transfer image receiving material in the form of the image.

The images obtained were subjected to status A reflection maximum density measurements, and the evenness of the images and thermal curl were also evaluated. The results obtained are shown in the Table 1 below.

TABLE 1

| Sample | Support | Dmax (Magenta) | Uniformity of Image | Fading* |
|---|---|---|---|---|
| 1 | (A) | 1.79 | ○ | ○ |
| 2** | (B) | 1.61 | ○ | X |
| 3 | (C) | 1.81 | ○ | ○ |
| 4** | (D) | 1.81 | X | ○ |
| 5 | (E) | 1.78 | ○ | ○ |
| 6 | (F) | 1.79 | ○ | ○ |
| 7 | (G) | 1.81 | ○ | ○ |

Note:
*Fading after 1 week at 60° C.
**Samples 2 and 4 are comparative samples and the other samples are those of the present invention.
○: good
X: not good It is clear from the results shown in Table 1 above that it is possible to obtain uniform images which have a high maximum density and with which there is little fading on ageing at elevated temperatures by using a support where the paper comprises natural pulp as the principal component as the base and which has a laminated layer of thickness of at least 5 μm and not more than 35 μm of which a polyolefin resin forms the principal component.

Furthermore, similar results were obtained by carrying out the same tests as described above where a subbing layer of gelatin of a thickness of 1 μm was present on the image receiving surface and Oil A shown below was added to the composition for the receiving layer described above.

Oil A

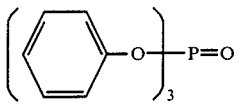

EXAMPLE 2

Samples 8 to 14 (as shown in Table 3) corresponding to Supports (A) to (G) were obtained in the same manner as in Example 1 except that the layer structure and the composition of the thermal transfer image receiving material used in Example 1 was changed to that shown in Table 2 below.

TABLE 2

| Layer | Composition | |
|---|---|---|
| Second Layer | Gelatin | 1.25 g/m$^2$ |
| | Polyester Resin (Vylon 300: made by Toyo Boseki) | 5 g/m$^2$ |
| | Surfactant (1)* | 0.5 g/m$^2$ |
| | Surfactant (2)* | 0.5 g/m$^2$ |
| | Carboxy Modified Silicone Oil (X-22-3710: made by Shinetsu Kagaku) | 0.5 g/m$^2$ |
| First Layer | Gelatin | 1.5 g/m$^2$ |
| | Film Hardening Agent (1)* | 0.12 g/m$^2$ |
| Support | (A) | |

Surfactant (1)*: Sodium dodecylbenzenesulfonate

Surfactant (2)*: $C_8H_{17}SO_2N(C_3H_7)CH_2COOK$

Film Hardening Agent (1)*:

$(CH_2NHCOCH_2SO_2CH{=}CH_2)_2CH_2NHCOCH_2SO_2CH{=}CH_2$

TABLE 3

| Sample | Support | Dmax (Magenta) | Evenness of Image |
|---|---|---|---|
| 8 (The Present Invention) | (A) | 1.83 | ○ |
| 9 (Comparative Ex.) | (B) | 1.66 | ○ |
| 10 (The Present Invention) | (C) | 1.85 | ○ |
| 11 (Comparative Ex.) | (D) | 1.86 | X |
| 12 (The Present Invention) | (E) | 1.82 | ○ |
| 13 (The Present Invention) | (F) | 1.83 | ○ |
| 14 (The Present Invention) | (G) | 1.86 | ○ |

○: good
X: not good

It is clear from the results shown in Table 3 that it is possible to obtain uniform images which have a high maximum density by using a support comprising paper in which natural pulp forms the principal component is used as the base and containing a laminated layer of thickness of at least 5 μm and not more than 35 μm of which a polyolefin resin forms the principal component.

Furthermore, similar results were obtained on carrying out the same tests as described above when 1 gram of the aforementioned Oil A was included in the image receiving layer (second layer) shown in Table 2.

While the invention has been described in detail and with reference to specific embodiments thereof, it will be apparent to one skilled in the art that various changes and modifications can be made therein without departing from the spirit and scope thereof.

What is claimed is:

1. A thermal transfer image receiving material comprising a support of a paper comprising natural pulp as a principal component, having laminated thereon a layer comprising a polyolefin resin as principal component, and further having thereon a dye image receiving layer, said dye image receiving layer containing a dye-accepting synthetic resin crosslinked by a hardening agent, and said polyolefin resin laminate layer having a thickness of from 5 to 35 μm.

2. The thermal transfer image receiving material of claim 1, wherein the natural pulp is wood pulp.

3. The thermal transfer image receiving material of claim 2, wherein the wood pulp is a kraft pulp, a sulfite pulp or a bleached pulp.

4. The thermal transfer image receiving material of claim 1, wherein the natural pulp includes additionally at least one of a softening agent, a paper strength reinforcing agent, a sizing agent, a filler and a fixing agent.

5. The thermal transfer image receiving material of claim 1, wherein the support of a paper has a coated layer of a hydrophobic polymer on one side or on both sides thereof.

6. The thermal transfer image receiving material of claim 1, wherein the polyolefin is a low density polyethylene, a high density polyethylene, a polypropylene or a mixture thereof.

7. The thermal transfer image receiving material of claim 1, wherein said polyolefin resin layer additionally contains at least one of a pigment, an antioxidant, and a fluorescent whitener.

8. The thermal transfer image receiving material of claim 1, wherein the material additionally comprises at least one dye image receiving layer capable of taking up and fixing a dye which migrates from a thermal transfer dye donating material as a result of heating.

9. The thermal transfer image receiving material of claim 8, wherein the dye image receiving layer contains a synthetic resin.

10. The thermal transfer image receiving material of claim 9, wherein the synthetic resin is an ester bond containing resin, a urethane bond containing resin, an amide bond containing resin, a urea bond containing resin or a highly polar bond containing resin.

11. The thermal transfer image receiving material of claim 8, wherein the dye image receiving layer additionally contains a high-boiling point organic solvent or a thermal solvent.

12. The thermal transfer image receiving material of claim 11, wherein the high-boiling point organic solvent is an ester, an amide, an ether, an alcohol, a paraffin or a silicone oil.

13. The thermal transfer image receiving material of claim 11, wherein the thermal solvent is a compound which is compatible with a dye, which is a solid at normal temperature but which melts when heated and which is not decomposed by heat during thermal activation.

14. The thermal transfer image receiving material of claim 13, wherein the thermal solvent is a compound having a melting point of from 35° C. to 250° C. and where the inorganic nature/organic nature ratio is less than 1.5.

15. A thermal recording material comprising (a) a thermal transfer image receiving material comprising a support of a paper comprising natural pulp as a principal component, having thereon a laminate layer comprising a polyolefin resin as a principal component, and further having thereon a dye image receiving layer, said dye image receiving layer containing a dye-accepting synthetic resin crosslinked by a hardening agent, and said polyolefin resin laminate layer having a thickness of from 5 to 35 μm, and (b) a thermal transfer dye donating material place in contact with the thermal transfer image receiving material, such that a dye can be transferred from the donating material to the receiving material.

16. A thermal transfer image receiving material of claim 1, wherein the synthetic resin for the image receiving layer is a polyester and the hardening agent is an isocyanate.

* * * * *